United States Patent [19]

Wilke

[11] Patent Number: 4,598,575

[45] Date of Patent: Jul. 8, 1986

[54] TIMER CALIBRATION METHOD AND APPARATUS

[75] Inventor: William G. Wilke, Arlington, Mass.

[73] Assignee: Tektronix, Inc., Beaverton, Oreg.

[21] Appl. No.: 694,376

[22] Filed: Jan. 24, 1985

[51] Int. Cl.[4] ..... G04F 5/00

[52] U.S. Cl. ..... 73/5

[58] Field of Search ..... 73/5

[56] References Cited

U.S. PATENT DOCUMENTS

| | | | |
|---|---|---|---|
| 1,954,313 | 10/1934 | Fuller | 73/5 X |
| 2,475,104 | 7/1949 | McGall | 73/5 |
| 2,602,324 | 7/1952 | Abell | 73/5 |
| 4,068,952 | 1/1978 | Erbert et al. | 73/5 X |
| 4,280,355 | 7/1981 | Donnally et al. | 73/5 |

FOREIGN PATENT DOCUMENTS

| | | | |
|---|---|---|---|
| 185429 | 11/1982 | Japan | 73/5 |
| 661491 | 5/1979 | U.S.S.R. | 73/5 |

OTHER PUBLICATIONS

Data File 112; "Time Interval Measurements and How to Make Them"; Berkeley Division of Beckman Instruments, Inc.; 9 page publication; by Feb. 1958.

*Primary Examiner*—Jerry W. Myracle

*Assistant Examiner*—Tom Noland

*Attorney, Agent, or Firm*—John P. Dellett; George T. Noe

[57] ABSTRACT

An apparatus for calibrating a timer of the type having a first and a second input channel in which an initial signal arriving over one input channel initiates a timing cycle, while a subsequent signal arriving over the other input channel terminates the timing cycle, the initial and subsequent signals being transported to remote ends of the first and second input channels from remote sources by means of first and second signal conductors. The apparatus comprises a commoning conductor, a test signal source, and first and second signal routing networks, the first signal routing network being capable of selectively coupling the first signal cable, the test signal source, one end of the commoning cable, and the first timer input channel, while the second signal routing network is capable of selectively coupling the second signal cable, the test signal source, or another end of the commoning cable and the second timer input channel. The differences in delay times associated with different signal paths are determined by a series of tests using the test signal source to generate signals to start and stop the timer, while the signal routing network configure the apparatus in selected testing arrangements.

19 Claims, 7 Drawing Figures

SWITCH POSITION
(X = IRRELEVANT)

| CONFIGURATION | SWITCH | a | b | c | d | e | f | a' | b' | c' | d' | e' | f' |
|---|---|---|---|---|---|---|---|---|---|---|---|---|---|
| | DIRECT | 2 | 1 | 2 | 1 | 2 | 1 | 2 | 1 | 2 | 1 | 2 | 1 |
| | DIRECT-SPLIT | 2 | 2 | 2 | 2 | 2 | 1 | 2 | 2 | 2 | 2 | 2 | 1 |
| | RISE TIME A | 2 | 2 | 2 | 2 | 1 | 1 | X | 2 | 1 | 1 | 1 | X |
| | RISE TIME B | X | 2 | 1 | 1 | 1 | X | 2 | 2 | 2 | 2 | 1 | 1 |
| | TEST 1 | 1 | 2 | 2 | 2 | 1 | X | 2 | 2 | 2 | 2 | 1 | 2 |
| | TEST 2 | 2 | 2 | 2 | 2 | 1 | 2 | 1 | 2 | 2 | 2 | 1 | X |
| | TEST 3 | 1 | 2 | 2 | 2 | 1 | X | X | 2 | 1 | 1 | 1 | X |
| | TEST 4 | X | 2 | 1 | 1 | 1 | X | 1 | 2 | 2 | 2 | 1 | X |

TIMER CALIBRATION METHOD AND APPARATUS

BACKGROUND OF THE INVENTION

The present invention relates in general to interval timers and particularly to a method and apparatus for calibrating such timers to reduce errors due to mismatches between separate timer input channel paths.

Two-channel interval timers typically measure the time difference between occurrence of events, represented by electrical signals, as they arrive at separate timer channel input terminals, the first arriving signal starting the timer and the second arriving signal stopping the timer. Since the signals usually originate at sources remote from the timer, a difference in the length of the path each signal must follow from the source to the timer can cause an error in the time measurement. Also, differences in the path lengths or internal switching means or other sources of delay within the timer itself, can cause additional errors in the time interval measurement.

What is needed, and would be useful, is a method and apparatus for measuring the error caused by differences in channel path lengths or other delay mechanisms between two input channels of an interval timer so that such error may be calibrated out of the time measurement.

SUMMARY OF THE INVENTION

According to one aspect of the present invention, a two-channel (A and B) timer measures the time difference between signals, generated at remote sources, as they arrive at each channel input terminal over separate signal transporting cables (cables A and B) connecting the remote signal sources to the timer. A first signal routing means selectively interconnects the A channel to the A cable, to a source of calibrating pulses, and/or to one end of a commoning cable. Similarly, a matching second signal routing means selectively couples the B channel to the B cable, to the test pulse source, and/or to a second end of the commoning cable.

Two measurements are made to determine the difference between the time delays inherent in the A and B channel paths due to differences in A and B cable lengths, differences in internal timer channel paths, or other causes of differing delay times between the two channel paths. In the first measurement the test pulse source and the commoning cable are connected to the A channel, while the commoning cable and the B cable are connected to the B channel. The B cable is open circuited at the remote end. The pulse source generates a pulse which travels along two paths, in one path going directly into the A input channel of the timer, and in the other path traveling over the commoning cable to the B cable and down the length of the B cable where it is reflected by the open circuited remote end. The reflected pulse travels back over the length of the B cable and into the B channel input. The time difference measured by the timer is thus the difference between the arrival times of the direct pulse entering the A channel and the reflected pulse entering the B channel.

The second measurement is similar to the first, with the roles of the A and B channels and cables reversed such that the timer measures the difference between the arrival of the direct pulse at the B channel and the arrival of the reflected pulses at the A channel. The difference in time delays associated with each channel is computed as half the difference between the time measurements made in the first and second tests.

According to another aspect of the present invention, the timer is calibrated for performing rise time measurements. In performing a rise time measurement, a signal travels from a remote source over the A cable and then splits, traveling in two directions, in one direction traveling to the A channel input and in another direction traveling over the commqning cable and into the B channel input. The A channel input is buffered by a comparator set to trigger the timer when the signal reaches a given voltage level, e.g. 10 percent of the signal peak, while the B channel is buffered by another comparator set to stop the timer when the signal voltage reaches a given higher voltage, e.g. 90 percent of signal peak. The timer therefore measures the rise time of the signal under test. However the difference in path lengths traveled by each pulse after the split causes an inaccurate rise time measurement. In a third test, the time delay difference associated with the differing path lengths are measured so that the timer may be calibrated for rise time measurements. In this third test, the buffering comparators are set to equal triggering levels, the A and B cables are automatically disconnected from the timer, the A and B channels are interconnected by the commoning cable, and the pulse source is applied to the A channel to generate a pulse which travels along two paths. In a first path, the pulse travels directly into the A channel comparator, triggering the timer. In the second path, the pulse crosses over the commoning cable and into B channel comparator, which generates a signal to the B channel input terminating the timer. The time thus measured is equal to the time delay difference associated with the different signal paths traveled by a signal during the rise time test, and this measured difference may be used to calibrate the timer to eliminate the measurement error resulting from the path difference.

If a rise time measurement is to be made on a signal originating on the B channel, then a fourth measurement is conducted, similar to the third, except that the roles of the A and B channels are reversed, with the pulse source being coupled to the B channel. When both the third and fourth measurements have been made, the time delay associated with the commoning cable may be computed as half the sum of the third and fourth measurement times while the difference between the time delays associated with the portions of the A and B channel paths downstream of the commoning cable may be computed as half the difference between the third and fourth measurement times. With these time delays known, the timer may be calibrated to account for signal path differences for any possible signal path interconnection.

It is accordingly an object of the present invention to provide a new and improved method and apparatus for calibrating a two channel interval timer to allow for differences in time delays between the signal path to each timer channel when measuring the time interval between two events.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a block diagram of an interval timer system utilizing the present invention, FIG. 2 is a block diagram of a connection arrangement for the timer system of FIG. 1 for performing a first calibrating test, FIG. 3 is a block diagram of a connection arrangement for the timer system of FIG. 1 for performing a second calibrating test, FIG. 4 is a block diagram of a connection arrangement for the timer system of FIG. 1 for performing a third calibrating test, FIG. 5 is a block diagram of a connection arrangement for the timer system of FIG. 1 for performing a fourth calibrating test, FIG. 6 is a combination block and schematic diagram showing the timer system of FIG. 1 in more detail, and FIG. 7 is a table listing switch positions of the timer system of FIG. 6 to be set during performance of the calibrating tests of FIGS. 2 through 5 and when making measurements following timer calibration.

DETAILED DESCRIPTION

Figure 1:
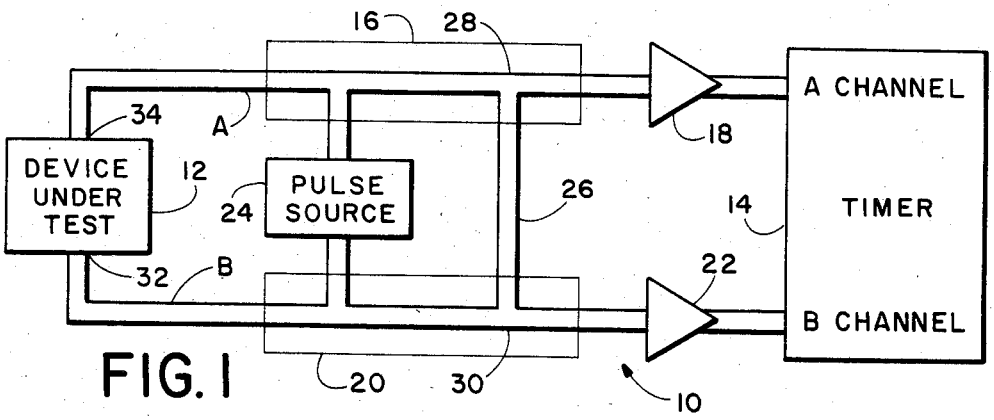

Referring to FIG. 1, an interval timer system 10, illustrated in block diagram form, is adapted to measure the time difference between two signals, originating at a remote device under test 12, as they reach the input terminals of timer 14. Timer 14 begins a timing cycle when a signal reaches either the A or the B input terminals of the timer and stops the timing cycle whenever a subsequent signal reaches the other input terminal.

To reach the A input of timer 14, one signal must travel over an A channel path, starting in device 12 at a remote end of a signal cable A, then pass through cable A to A channel signal routing means 16 and A channel input buffer 18, and into the A channel input of timer 14. Similarly, a second signal, produced at device 12, must travel to the B channel input of timer 14 over a B channel path comprising another signal cable B, a B channel signal routing means 20, and a B channel buffer 22. The A and B external signal paths may be of different lengths, such that pulses traveling over the A and B paths will be delayed by differing amounts of time. If it is intended that timer 14 measure the time difference between two events occurring at remote device 12, then the delay difference between the A and B path lengths, traversed by two signals generated by the remote events, will introduce an error into the time difference measured by timer 14. Also delay differences between the channel routing means (16 and 20), path lengths, or other aspects of the internal channel A and B circuits of timer 14 may introduce additional errors into the measurement.

Figure 2:
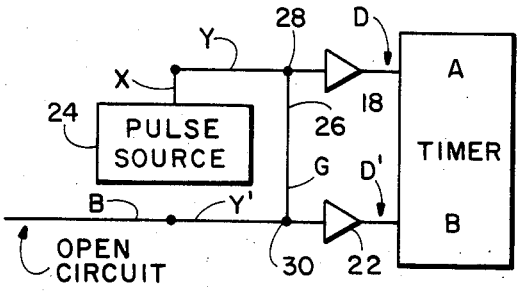

A and B channel routing means 16 and 20, pulse source 24 and commoning cable 26 of FIG. 1 permit measurements which may be used to calculate the effect of the aforementioned differences in the A and B channel signal delaying mechanisms. To prepare for a first measurement, A channel signal routing means 16 disconnects the A signal cable from channel A, and connects pulse source 24, and one end of commoning cable 26, to the A channel. B channel signal routing means 20 disconnects pulse source 24 from the B channel, while connecting the B signal cable and a second end of commoning cable 26 to the B channel. The B cable is open circuited at the remote end. A block diagram of the system configuration for the first measurement is shown in FIG. 2.

To perform the first test, pulse source 24 generates a pulse which travels over paths X and Y to the junction 28 between the A channel path and commoning cable 26, and then splits to form two pulses, with one pulse traveling down path D to the A channel input and the other pulse traveling down path G to the junction 30 between the commoning cable 26 and the B channel path. At junction 30, the pulse again splits, with one pulse traveling down path D′ toward the B input of timer 14, while the other pulse travels down path Y′ to the B cable and then down the B cable (path B) to the remote end 32 of the cable where it is reflected by the open circuit. The reflected pulse travels back along the B cable and over paths Y′ and D′ toward the B input of timer 14.

The pulse entering the A channel of timer 14 starts the timer. Buffer 22 of the B channel input is adjusted such that the first pulse reaching the buffer directly from junction 30 is not of sufficient magnitude to reach the B input of timer 14. However, if the original pulse generated by pulse source 24 is of sufficient duration, the magnitude of the reflected pulse arriving later at buffer 22 adds to the magnitude of the previously arriving nonreflected pulse, and with buffer 22 properly adjusted, the combination of reflected and nonreflected pulses is sufficient to pass through buffer 22 and reach the B channel input of timer 14 thereby stopping the timer. The resulting time difference (T1), between the pulses entering the A and B channels, is measured by timer 14 and recorded.

The above discussion describes the reflection from the external cable B's "open circuited" end. Clearly, a useful reflection could also be generated if cable B's end were "shorted". The present invention is understood to include, at the cable's end, any impedance discontinuity producing a positive or negative reflection of size sufficient to be singled out and triggered upon by the buffer comparator 22.

Figure 3:
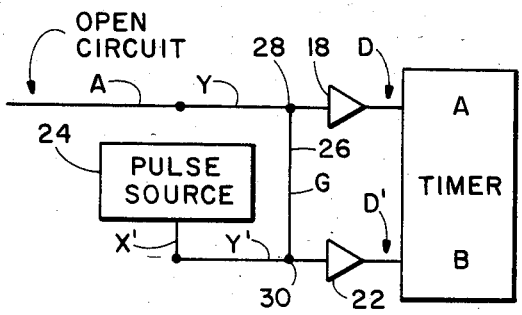

The second measurement is similar to the first with the roles of the A and B channels and cables being reversed. Pulse source 24 is connected to the B channel through signal routing means 20 while the open circuited A cable is connected to the A channel. As in the first test, commoning cable 26 interconnects the A and B channels. A diagram of the system configuration for the second test is shown in FIG. 3. With buffer 18 of the A channel properly adjusted, a pulse generated by pulse source 24 will directly enter the B input of timer 14, via paths X′, Y′ and D′, to start the timer. The same pulse also travels over paths X′ and Y′, through the commoning cable 26 (path G), and down cable A (path A) where it is reflected by open circuit end 34, back down cable A (path A again), and finally, through buffer 18 and into the A input of the timer (path D) to stop the timing cycle.

With the time delays associated with each path in FIGS. 2 and 3 also represented by the path designations, the time measurements produced by timer 14 during the first and second tests, T1 and T2 respectively, may be computed as follows:

$$T1=(2B+Y+2Y'+X+G+D')-(X+Y+D)$$
$$=2B+2Y'+G+D'-D$$

$$T2=(2A+Y'+2Y+X'+G+D)-(X'+Y'+D')$$
$$=2A+2Y+G+D-D'$$

Subtracting T2 from T1 and dividing by 2, the above relations yield the following expression:

$$(T2-T1)/2=(A+Y+D)-(B+Y'+D') \quad [1]$$

In measuring the time difference between two signal generating events at device 12, signal routing means 16 and 20 connect the A and B cables from device 12 to the A and B inputs of timer 14 through buffers 18 and 22. The commoning cable 26 and pulse source 24 are disconnected from the A and B channels. Since (A+Y+D), of Equation [1] above, is the delay time associated with the A channel path from device 12 to the A input of timer 4, and since the quantity (B+Y'+D'), of Equation [1], is the delay time associated with the B channel path from device 12 to the B input terminal of timer 14, the quantity (T2−T1)/2, of Equation [1], is the difference between the delay times associated with each path. This computed time difference is suitably added to, or subtracted from, any time measurements made by timer 14 of time differences between two signals arriving at the A and B channel inputs over the A and B cables to account for any difference in signal path lengths.

The timing system 10 of FIG. 1 may also be configured to measure rise times of a signal produced by device 12 and transmitted to the timer either on the A or the B cable. Assuming the signal is to be transmitted to the timing system on the A cable, signal routing means 20 is set to disconnect the B cable from the B channel of the timer system, while signal routing means 16 is set to connect the A cable to the A channel of the timer system. Signal routing means 16 and 20 interconnect the A and B channels through commoning cable 26 while disconnecting pulse source 24 from both channels.

When a signal to be measured is generated by device 12, it travels down the A cable to node 28 and then splits, traveling along two paths, towards buffer 18 and also towards buffer 22 after traveling over commoning cable 26. If a rise time is to be measured, buffer 18 of the A channel is adjusted such that the signal under test is gated to the timer 14 A input to start the timing cycle when the signal reaches 10% of its peak value. At the same time, buffer 22 of the B channel is adjusted to pass the signal to the B timer input, to stop timer 14, when the signal under test reaches 90% of its peak value. The resulting measurement is then nominally equal to the 10%-to-90% rise time of the signal when adjusted for errors due to the delay times associated with the different paths the test signal follows in reaching the A and B timer inputs.

Figure 4:
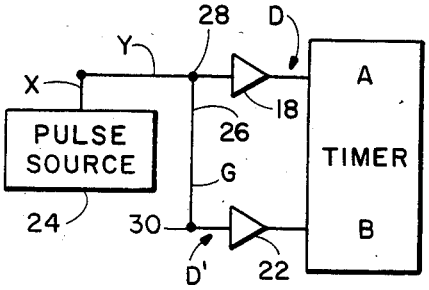

The delay errors may be determined by performing a third calibration test. Switching means 16 disconnects cables A and B from the A and B timer channels, and connects commoning cable 26 between the A and B timer channels. Then a pulse from pulse source 24 is generated on the A channel. As shown in a diagram of the system configuration for the third test, FIG. 4, this pulse travels over paths X and Y to node 28 where it splits, traveling in one direction over path D to the A input of timer 14, and in another direction over paths G and D' into the B input of timer 14. If buffers 18 and 22 are set to trigger at the same voltage, then the time difference (T3) between the pulse arriving at the A input of timer 14 and the pulse arriving at the B input of the timer is computed as follows:

$$T3=(X+Y+D)-(X+Y+G+D')=D-D'-G$$

Since the quantity (D−D'−G) is equal to the difference in delay times associated with the different paths followed by a signal during a rise time test, the time T3 may be subtracted from the measured rise time to yield an actual rise time for the signal. Additional pulses from pulse source 24 can be measured as described above, and the results averaged, to improve the resolution of the tests T1, T2, T3, and T4 herein described.

Figure 5:
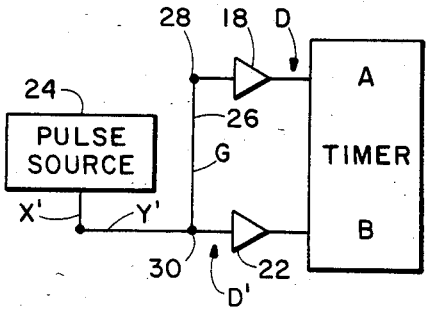

The timer system 10 of FIG. 1 may also be configured to permit a rise time measurement of a signal transmitted by device 12 over the B cable by connecting the B cable to the B channel and disconnecting the A cable. The signal then travels over the B cable to node 30 where it splits, traveling in one direction to buffer 22 and in another direction to buffer 18 after passing over commoning cable 26. A similar calibrating test may be conducted to account for the difference in path lengths, with cables A and B disconnected from system 10 and with pulse source 24 applying a pulse to the B channel as depicted in FIG. 5. The time interval (T4) measured by timer 14, with buffers 18 and 20 adjusted to pass signals of the same magnitude, is the following:

$$T4=(X+Y+D')-(X+Y+G+D)=D'-D-G$$

This quantity may be then be used to adjust any rise time measurements made on a signal entering timer system 10 on the B channel. From the above relations it is noted that:

$$(D'-D)=(T4-T3)/2$$

$$G=(T3+T4)/2$$

These relations permit the calculation of delay time differences associated with nearly any combination of signal paths possible in timing system 10 of FIG. 1, when using A and B cables of known or matching delay times, on the basis of tests 3 and 4 only, without the necessity of performing tests 1 and 2 described hereinabove.

Once the four test quantities T1, T2, T3 and T4 have been determined, other useful results can be calculated therefrom. For example, the length of the external channel B cable can be calculated as: $B=\frac{1}{2}(T1-T3)$. Similarly, the A channel cable is $A=\frac{1}{2}(T2-T4)$.

Figures 6, 7:
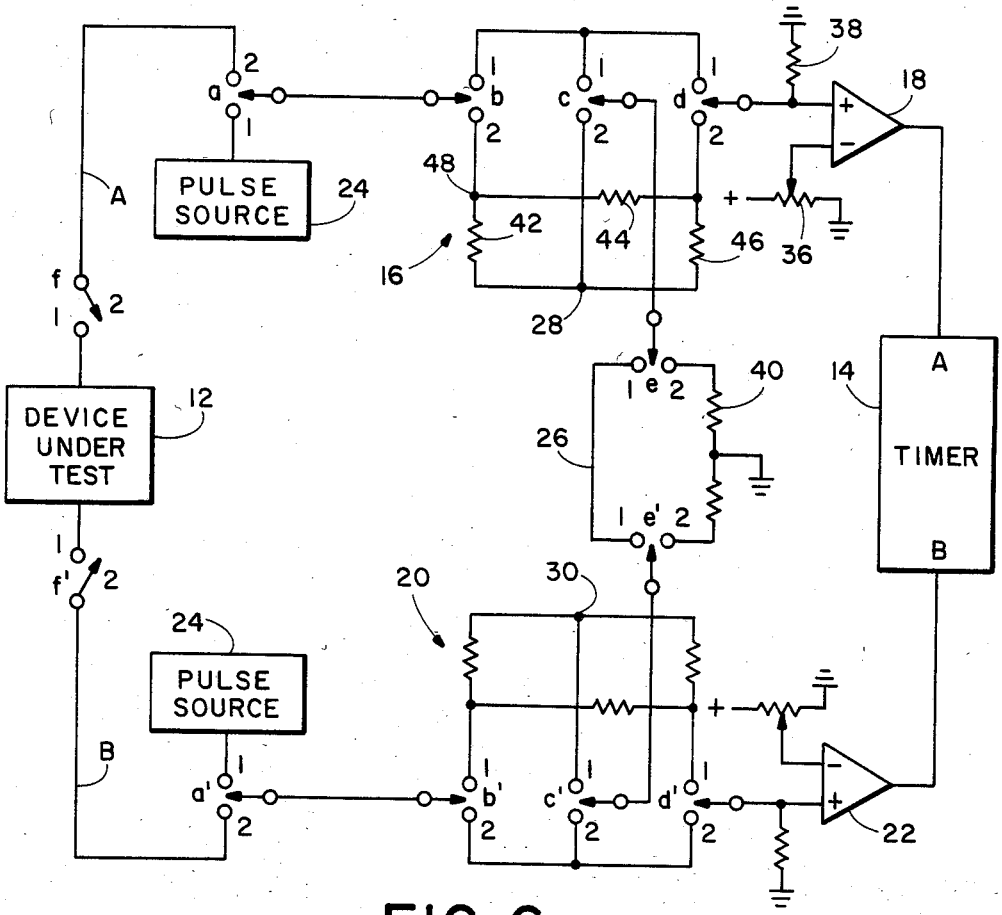

A more detailed embodiment of the interval timer system 10 of FIG. 1 is shown in FIG. 6, in combination block and schematic diagram form. External cables A and B are connected to the device under test 12 at terminals 1 of switches f and f'. To prevent unwanted signal reflections in the system, the A and B cables, and all signal paths within the timer system 10 have the same characteristic impedance, e.g. 50 OHMS. A signal originating at terminal 1 of switch f, with switch f in position 1, travels down the A cable to the A channel input of the timer system at terminal 2 of switch a of signal routing means 16. Switching means f and f' include embodiments where the user manually opens the cable end.

If switch a of signal routing means 16 is in position 1, then pulse source 24 is connected to the A channel while the A cable is disconnected. Alternatively, when switch a is in position 2, the pulse source is disconnected from the A channel and the A cable is connected. With switches b and d of signal routing means 16 in position 1, the signal from the pulse source or device 12 passes through signal routing means 16 to buffer 18. Buffer 18, in the preferred embodiment, comprises a comparator, the A channel signal being applied to a noninverting input while an adjustable reference voltage from pot 36 is applied to an inverting input. If the magnitude of the A channel signal exceeds the applied reference voltage, buffer 18 generates an output signal to the A channel input of timer 14. A 50 Ohm termination resistor 38 grounds the noninverting input of buffer 18 through the characteristic impedance of the signal path to prevent reflection of arriving signals.

If switch c of signal routing means 16 is in position 1, and switch e of signal routing means 16 is in position 2, while switches b and c are in position 1, then a signal passing over the A channel is split as it reaches node 28 with half the current passing to buffer 18 and half the current passing to ground through resistor 40. Thus switches c and e, and resistor 40 may be used, when desired, as a power splitter to reduce the magnitude of A channel signals before they reach buffer 18.

Signal routing means 16 also includes a delta network of 50 Ohm resistors, 42, 44 and 46 with resistors 42 and 44 being connected in common to terminal 2 of switch b, resistors 42 and 46 being connected in common to terminal 2 of switch c and with resistors 44 and 46 being connected in common to terminal 2 of switch d. When a signal entering the A channel at switch a is to be transmitted to buffer 18 and to the B channel, switches b, c and d are switched to position 2 while switch e is switched to position 1. The signal then splits at node 48, with part of the signal passing through resistor 44 and switch d to buffer 18 and with another part of the signal passing through resistor 42 and switches c and e to commoning cable 26, which carries the signal on to the B channel. If the resistor bridge is of the same length on each side, and if resistors 42, 44 and 46 are well matched, no portion of the signal passes through resistor 46.

The B channel signal routing means 20 is identical in construction and operation to A channel signal routing means 16, and corresponding switches are indicated with similar reference characters a' through e'. The switch positions for the switches of signal routing devices 16 and 20, along with switches f and f' of FIG. 6, for various test configurations of the timing system are listed in tabular form in FIG. 7. In the "direct" mode, timer 14 measures the time difference between signals generated by device 12. Switches f, f', b, b', d and d' are in position 1 while switches a, a', c, and c' are in position 2. The positions of switches e and e' are not directly part of the signal path, but are set to position 2 to improve the isolation between channels A and B. When the power splitting feature of signal routing means 16 and 20 is utilized during a direct measurement, switches a, a', b, b', c, c', d, d', e and e' are set to position 2, while switches f and f' are set to position 1.

When a signal generated by device 12 is to be transmitted to the timer over the A cable for a rise time measurement, switching means e, e', c', d' and f are switched to position 1 while switches a, b, b', c, and d are switched to position 2. The positions of switching means f' and a' are irrelevant. Alternatively, when a signal generated by device 12 is to be transmitted to the timer over the B cable for a rise time measurement, switching means e, e', c, d and f' are set to position 1, while switching means a', b, b', c' and d' are set in position 2, the positions of switching means a and f being irrelevant.

When performing calibrating test 1, as described hereinabove, to calibrate for a direct measurement, switch a is placed in position 1 to connect pulse source 24 to the A channel while switch a' is put in position 2 to connect the B cable to the B channel. Switch f' is put in position 2 to open circuit the B cable at the remote end. Switches e and e' are put in position 1 to couple the A and B channels through commoning cable 26 and switches b, b, c, c', d, and d' are all placed in position 2. The switch position of switch f is irrelevant.

The signal leaves source 24 and is divided by the power splitter formed by resistors 42, 44, and 46. A portion of the signal then goes to comparator 18, which is set to trigger on that first edge. A portion of the signal also proceeds through the commoning cable 26 to the power splitter and switching means 20. A portion of this signal proceeds directly to comparator 22, but 22 is set to not trigger on this first edge. Another portion of the signal travels out external cable B, is reflected at its end, and arrives back at the power splitter and switching means 20. It is further divided, with a portion of the signal returning up the commoning cable and another portion arriving at comparator 22 superimposed on top of the first edge. Comparator 22 is set to trigger on this second (reflected) edge.

To prepare for calibrating test 2, also described hereinabove, the switch positions and buffer settings are the same as for test 1 except switches a and f are placed in position 2, switch a' is set to position 1, and the position of switch f' is irrelevant. The comparators 18 and 22 have their trigger levels swapped. If corresponding signal paths within signal routing devices 16 and 20 are closely matched such that delay time differences therebetween are negligible, then the difference between the timer readings obtained in test 1 and test 2 will be equal to the difference between the delay times associated with the A signal path, from switch f to timer 14 input A, and the B signal path, from switch f' to the B input of timer 14. This calculated difference may be used to calibrate the timer when performing either the direct or direct-power split time measurements described hereinabove.

To configure timing system 10 for performing previously described test 3, used to calibrate the timer before a rise time measurement on a signal originating on the A channel, switches a, e, c', d', and e' are switched to position 1 while switches b, c, d, and b' are set to position 2, with the positions of switches f, a' and f' being irrelevant. Buffers 18 and 22 are identically adjusted. The time (T3) measured by timer 14 as a result of a pulse generated by pulse source 24 may be used to correct the time measured during the rise time test.

Similarly, to configure the system for test 4 for generating a fourth time measurement (T4), used to calibrate for a rise time test on a signal originating on the B channel, switches c, d, e, a', and e' are set to position 1 while switches b, b', c', and d' are set to position 2, the positions of switches a, f, and f' being irrelevant.

One half of the sum of the measured T3 and T4 times is equal to the signal delay time associated with the signal path from node 28 to node 30 of FIG. 6, including commoning cable 26, provided that delay times associated with corresponding signal paths of signal routing means 16 and 20 are no more than negligibly different. One half the difference between the measured T4 and T3 times is equal to the difference between delay times associated with the A channel path, from switch a to the A input of timer 14, and the B channel path, from switch a' to the timer 14 B input, assuming again that corresponding signal paths within signal routing means 16 and 20 are closely matched or negligibly short. The calculated commoning path delay time, along with the calculated difference between the A and B path delay times may be used in appropriate combination to calibrate the timer when external cables A and B of known, or matching, delay times are used in conjunction with timer system 10, or when external cables are used, thereby obviating the need for tests 1 and 2.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A method for generating a calibrating time for an interval timer, of the type having a first and a second input channel in which an initial signal arriving over one input channel initiates a timing cycle while a subsequent signal arriving over the other input channel terminates the timing cycle, the method comprising the steps of:

a. interconnecting remote ends of the first and second input channels by interconnecting means, b. placing a first signal on the remote end of the first input channel such that said first signal initiates a first timing cycle after passing over said first input channel, and terminates the first timing cycle after passing over said channel interconnecting means and said second channel; and c. placing a second signal on the remote end of the second input channel such that said second signal intiates a second timing cycle after passing over said second input channel, and terminates the second timing cycle after passing over said channel interconnecting means and said first input channel.

2. A method as in claim 1 further comprising the step of:

d. algebraically summing the first and second timing cycle times.

3. A method as in claim 2 further comprising the step of:

e. halving the quantity calculated in step d.

4. A method for generating a calibrating time for an interval timer, of the type having a first and a second input channel in which a first signal, arriving over one input channel, initiates a timing cycle, while a second signal, arriving over the other input channel, terminates the timing cycle, the first and second signals having been transported to the first and second input channels from remote sources by means of first and second input conductors, the method comprising the steps of:

a. interconnecting external ends of the first and second input channels by interconnecting means, b. connecting the second input conductor to the external end of the second input channel, and c. placing a first test signal on the remote end of the first input channel such that said first test signal initiates a first timing cycle, after passing over said first input channel, and terminates said first timing cycle, after passing over said channel interconnecting means, traveling to a remote end of the second input conductor, reflecting back over said second input conductor after reaching a remote end of said second conductor, and then passing over the second input channel.

5. A method as in claim, 4 further comprising the steps of:

d. connecting the first input conductor to the remote end of the first input channel, and e. placing a second test signal on the remote end of the second input channel such that said second signal initiates a second timing cycle, after passing over said second input channel, and terminates said second timing cycle, after passing over said interconnecting means, traveling to a remote end of said first conductor, reflecting back over said first conductor after reaching said remote end of said first conductor, and then passing over the first input channel.

6. A method as in claim 5 further comprising the step of:

f. differencing the first and second timing cycle times.

7. A method as in claim 6 further comprising the step of:

g. halving the result of step f.

8. An apparatus for calibrating a timer of the type having a first and a second input channel in which an initial signal, arriving over one input channel, initiates a timing cycle, while a subsequent signal, arriving over the other input channel, terminates the timing cycle, the apparatus comprising:

a commoning conductor, a test signal source, first signal routing means to selectively connect a remote end of said first input channel to one end of said commoning conductor, and to said test signal source, and second signal routing means to selectively connect a remote end of said second input channel to another end of said commoning conductor, such that by placing a first test signal from the test signal source on said remote end of the first input channel, said first test signal initiates a first timing cycle after passing over said first input channel, and terminates said first timing cycle after passing over said commoning conductor and said second channel.

9. An apparatus as in claim 8 wherein said first signal routing means comprises a signal splitting network.

10. An apparatus as in claim 9 wherein said signal splitting network comprises three matching resistors connected in delta fashion.

11. An apparatus as in claim 10 wherein said matching resistors are of resistance equal to the characteristic impedance of the first input channel.

12. An apparatus as in claim 9 wherein said first signal routing means further comprises:

an input terminal for receiving externally generated signals, a commoning terminal, a bypass conductor, first switch means to selectively connect said input terminal to either said bypass conductor or to said signal splitting network, second switch means to selectively connect said one end of said commoning terminal either to said bypass conductor or to said signal splitting network, and third switch means to selectively connect said remote end of said first input channel either to said bypass conductor or to said signal splitting network.

13. An apparatus as in claim 12 wherein said first signal routing means further comprises fourth switch means to selectively connect said input terminal to either said first signal conductor or to said test signal source.

14. An apparatus as in claim 12 wherein said first signal routing means further comprises:

a terminating impedance, and fifth switch means to selectively connect said commoning terminal either to said one end of said commoning cable or to said terminating impedance.

15. An apparatus as in claim 14 wherein said first signal conductor, said first input channel and said terminating impedance have the same characteristic impedance.

16. An apparatus as in claim 12 wherein said first and second signal routing means comprise matching components such that corresponding signal paths therein exhibit substantially similar delay times.

17. An apparatus for calibration for a timer of the type having a first and a second input channel in which an initial signal arriving over one input channel initiates a timing cycle, while a subsequent signal arriving over the other input channel terminates the timing cycle, the apparatus comprising:

a commoning conductor, a test signal source, first signal routing means to selectively connect a remote end of said first input channel to one end of said commoning conductor and to said test signal source, and second signal routing means, to selectively connect a remote end of said second input channel to another end of said commoning conductor and to said test signal source, such that by placing a first test signal from the test signal source on the remote end of the first input channel, said first test signal initiates a first timing cycle, after passing over said first input channel, and terminates said first timing cycle after passing over said commoning conductor and said second channel, and such that by placing a second test signal from said test signal source on said remote end of said second input channel, said second signal initiates a second timing signal, after passing over said second input channel, and terminates the second timing cycle, after passing over said commoning conductor and said first input channel.

18. An apparatus for calibrating a timer of the type having a first and a second input channel in which an initial signal arriving over one input channel initiates a timing cycle, while a subsequent signal arriving over the other input channel terminates the timing cycle, said initial and subsequent signals being transported to remote ends of said first and second input channels from remote sources by means of first and second signal conductors, the apparatus comprising:

a commoning conductor, a test signal source, first signal routing means to selectively connect said remote end of said first input channel to one end of said commoning conductor, and to said test signal source, and second signal routing means, to selectively connect said remote end of said second input channel to another end of said commoning conductor, to a first end of said second signal conductor, and to said test signal source, such that by placing a first test signal from the test signal source on said remote end of said first input channel, said first test signal initiates a first timing cycle, after passing over said first input channel, and terminates said first timing cycle after passing over said commoning conductor, traveling to a remote end of said second signal conductor where said first test signal is reflected, passing back over said second conductor and passing over said second input channel.

19. An apparatus for calibrating a timer of the type having a first and a second input channel in which an initial signal arriving over one input channel initiates a timing cycle, while a subsequent signal arriving over the other input channel terminates the timing cycle, said initial and subsequent signals being transported to remote ends of said first and second input channels from remote sources by means of first and second signal conductors, the apparatus comprising:

a commoning conductor, a test signal source, first signal routing means to selectively connect said remote end of said first input channel to one end of said commoning conductor, to a first end of said first signal conductor, and to said test signal source, and second signal routing means, to selectively connect said remote end of said second input channel to another end of said commoning conductor, to a first end of said second signal conductor, and to said test signal source, such that by placing a first test signal from the test signal source on said remote end of said first input channel, said first test signal initiates a first timing cycle, after passing over said first input channel, and terminates said first timing cycle, after passing over said commoning conductor, traveling to a remote end of said second signal conductor where said first test signal is reflected, passing back over said second conductor and then passing over said second input channel, and such that by placing a second test signal from the test signal source on said remote end of said second input channel, said second test signal initiates a second first timing cycle, after passing over said second input channel, and terminates said second timing cycle, after passing over said commoning conductor, traveling to a remote end of said first signal conductor, where said second test signal is reflected, passing back over said first conductor, and then passing over said second input channel.

* * * * *